United States Patent [19]

Katakura et al.

[11] 4,008,686

[45] Feb. 22, 1977

[54] DEVELOPING DEVICE FOR USE IN ELECTROPHOTOGRAPHY

[75] Inventors: Hiroshi Katakura, Hachioji; Keitaro Yamashita, Kamisato, both of Japan

[73] Assignee: Konishiroku Photo Industry Co., Ltd., Tokyo, Japan

[22] Filed: May 16, 1975

[21] Appl. No.: 578,266

[30] Foreign Application Priority Data

May 21, 1974 Japan ..... 49-56864

[52] U.S. Cl. ..... 118/651; 355/3 DD; 427/18

[51] Int. Cl.[2] ..... B05B 5/02

[58] Field of Search ..... 118/637; 427/18; 355/300

[56] References Cited

UNITED STATES PATENTS

| | | | |
|---|---|---|---|
| 3,318,284 | 5/1967 | Hojo et al. | 118/637 |
| 3,543,720 | 12/1970 | Drexler | 118/637 |
| 3,641,980 | 2/1972 | Bickmore | 118/637 |
| 3,654,902 | 4/1972 | Hakanson | 118/637 |
| 3,788,275 | 1/1974 | Hanson | 118/637 |
| 3,882,821 | 5/1975 | Katayama et al. | 118/637 |

*Primary Examiner*—Ronald Feldbaum
*Attorney, Agent, or Firm*—Bierman & Bierman

[57] ABSTRACT

A developing apparatus for applying toner to an electrophotographic surface comprising a toner chamber, a plurality of rotatable means for moving toner from the chamber to the electrophotographic surface.

7 Claims, 2 Drawing Figures

DEVELOPING DEVICE FOR USE IN ELECTROPHOTOGRAPHY

Figure 1:
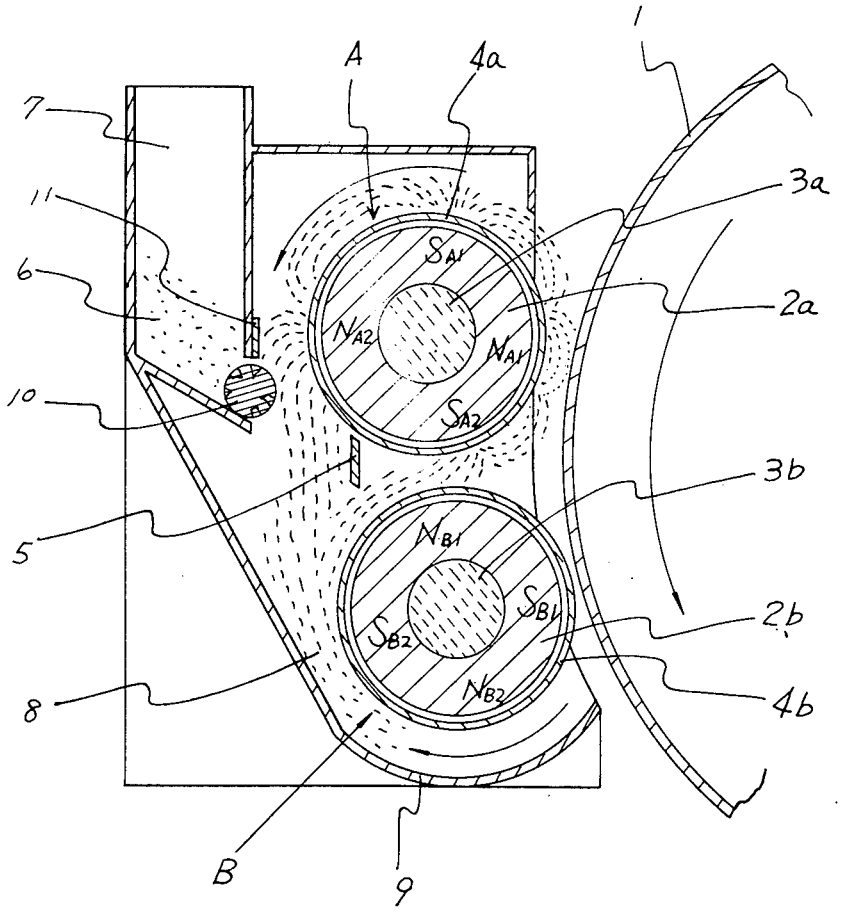

This invention relates to a developing device for electrophotographic reproduction system in which a latent image electrically produced in electrophotography or facsimile that is so-called an electrostatic latent image is developed to change into a visible image.

Generally, a developing method of magnetic brush type has been widely used in which a developer such as uni-component developer composed of mixture of pulverized resin and pigment (generally referred to as a toner) and powdered magnetic material (generally referred to as a carrier) or bi-component developer composed of pulverized magnetic material coated with a resin is electrostatically charged in advance and then magnetically attracted onto the magnet surface directly or indirectly to provide a so-called magnetic brush with which is rubbed the surface of a sheet having an electrostatic latent image of opposite polarity to the toner formed thereon so that the toner of the developer is transferred to the surface of the latent image bearing sheet for development. There have been proposed various kinds of developing devices for use in such developing method of magnetic brush type and they are practically used in the art. These developing devices are successfully used in some aspects, but have some drawbacks in other aspects. The drawbacks are that the developed image has uneven concentration due to insufficiency in transfer of the developer, formation of the magnetic brush, mixture of the developer and scatter of carrier iron powder and that some of the devices are troublesome in maintenance due to complicated structure.

It is a principal object of the present invention to provide a developing device capable of preventing unevenness in transfer occurred in the transfer of the images onto the photoconductive body.

It is another object of the invention to provide a developing device for electrophotography capable of preventing unevenness in transfer such as white dots occurred on a transfer sheet due to adherence of carriers to the surface of the latent image bearing sheet.

It is further object of the invention to provide a developing device for electrophotography capable of supplying the developer to a developing station continuously in a stable manner.

It is still further object of the invention to provide a developing device for electrophotography capable of forming a magnetic brush with newly supplied developer at all times by removing the used developer from the magnet roll providing the magnetic brush for development.

The developing device according to the present invention comprises more than two magnet rolls, one being a developing magnet roll located adjacent a rotary drum which may bear an electrostatic latent image thereon and the other being a developer supply magnet roll located oppositely to the developing magnet roll and also to the rotary drum at the position advanced in the direction of rotation of the drum.

Each of the magnet rolls used in the present invention comprises a cylindrical magnet body including a plurality of magnetic poles of different polarities spaced along its outer portion and a tube located outside of the magnet body rotatably with respect thereto, which tube is made of non-magnetic material such as, for example stainless steel and aluminum so that magnetic poles corresponding to those of the magnet body appear on the surface of the tube. The magnet body is fixedly supported at its longitudinal axis in a conventional manner.

In the developing device for electrophotography, an electrostatic latent image is optically formed on a photoconductive sheet and the sheet bearing the latent image is brought into the position opposite to the magnet rolls as the photoconductive body is advanced with the rotary drum whereupon the surface of the sheet is rubbed with the magnetic brush of the developer provided on the surface of the magnet rolls. As a result, the developer or the toner of the developer as electrostatically discharged is attracted by electrostatic force and adhered to the surface of the latent image bearing sheet so that the latent image is rendered visible.

According to the invention, there are provided a developing magnet roll adjacent to the rotary drum with a magnetic pole, which is called a developing magnetic pole, positioned adjacent the surface of the drum and a developer supply magnet roll also oppositely to the rotary drum at an advanced position in the direction of rotation thereof with a magnetic pole positioned adjacent the drum surface.

The carrier adhered to the latent image bearing sheet or the rotary drum itself is removed by the magnetic pole of the developer supply magnet roll opposite to the drum. In case use is made of the uni-component developer the surplus of the developer adhered to the rotary drum is removed by the same magnetic pole.

In the present invention, the developing magnet roll and the developer supply magnet roll have magnetic poles of different polarity at their substantially opposite positions. It is important to select the magnetic coupling between the magnetic pole of the developing magnet roll located at the opposite position and the magnetic pole of opposite polarity on the same magnet roll next to the magnetic pole as viewed in the direction of rotation of the rotatable tube outside the developing magnet roll greater than the magnetic coupling between the magnetic poles of different polarities on the magnetic body of the developing magnet roll and the developer supply magnet roll located at their opposite positions thereof, from the standpoint of supply of the developer. The magnetic coupling between magnetic poles is indicated by intensity of magnetism produced between the magnetic poles depending upon distance therebetween and disposition of the magnetic poles and is measured in terms of magnetic attractive force acting on a soft magnetic material when placed between the magnetic poles.

It is to be noted in the present invention that the magnetic coupling between the magnetic pole on the magnet body of the developing magnet roll located at the opposite position to the developer supply magnet roll and the magnetic pole of opposite polarity on the same magnet body next to the magnetic pole as viewed in the direction of rotation of the rotary tube is of greater extent than the magnetic coupling between the magnetic pole on the magnet body of the developing magnet roll located at the opposite position to the developing magnetic roll and the magnetic pole of the same polarity on the magnet body of the developer supply magnet roll next to the magnetic pole located at the opposite position as viewed in the direction of rotation of the rotatable tube outside the developer supply magnet roll.

It is also important to note that there is magnetic attraction between the magnetic pole located at the opposite position and the magnetic pole next thereto on the magnet body of the developing magnet roll as viewed in the direction of rotation of the rotatable tube while there is magnetic repulsion between the magnetic pole on the magnet body of the developing magnet roll located at the opposite position and the magnetic pole on the magnet body of the developer supply magnet roll next to the magnetic pole thereon located at the opposite position as viewed in the direction of rotation of the rotatable tube.

The developer supply magnet roll serves to supply the developer. More particularly, this magnet roll attracts the developer with the aid of at least one magnetic pole disposed in the supply of the developer and carries the developer to the opposite positions of the two magnet rolls as the rotatable tube rotates around the magnet body of the developer supply magnet roll. Then the developer is attracted onto the surface of the rotational tube of the developing magnet roll by the magnetic pole on the magnet body of the developing magnet roll located at the opposite position. As the rotatable tube rotates around the magnet body, the developer is carried with the tube by the magnetic pole next to the magnetic pole at the opposite position which establishes the strong magnetic coupling between the magnetic poles. In this way, the developer is completely transferred from the surface of the rotating tube of the developer supply magnet roll to that of the rotatable tube of the developing magnet roll with the magnetic coupling established between the magnet rolls. The developer is thus carried with the rotating tube to the developing magnetic pole on the developing magnet body whereupon a magnetic brush is formed.

With the magnet rolls with magnetic poles above arranged, stable supply of the developer to the developing station is achieved and useless supply of the developer to the developer supply magnet roll can be avoided.

It is important to provide a magnetic pole on the magnet body of the developing magnet roll for facilitating separation of the developer from the surface of the rotating tube of the magnet roll.

An additional magnetic pole is provided on the magnet body of the developer supply magnet roll the polarity of which magnetic pole is opposite to that of the magnetic pole for facilitation of separation of the developer. Preferably, the magnetic coupling between these two magnetic poles is greater than that between the separation-facilitation magnetic pole and any of the magnetic poles on the magnet body of the developer supply magnet roll. It is desirable to provide an additional magnetic pole in the vicinity of the magnetic pole on the magnet body of the developer supply magnet roll whose magnetic coupling to the separation-facilitation magnetic pole is the greatest and the polarity of the additional magnetic pole is preferably opposite to the polarity of the separation-facilitation magnetic pole.

Thus, the surplus of the developer carried with the rotatable tube associated with the developing magnet body is easily removed or separated from the surface of the tube with the aid of the magnetic coupling established between the separation-facilitation magnetic pole on the developing magnet body and the magnetic pole on the developer supply magnet body.

Figure 2:
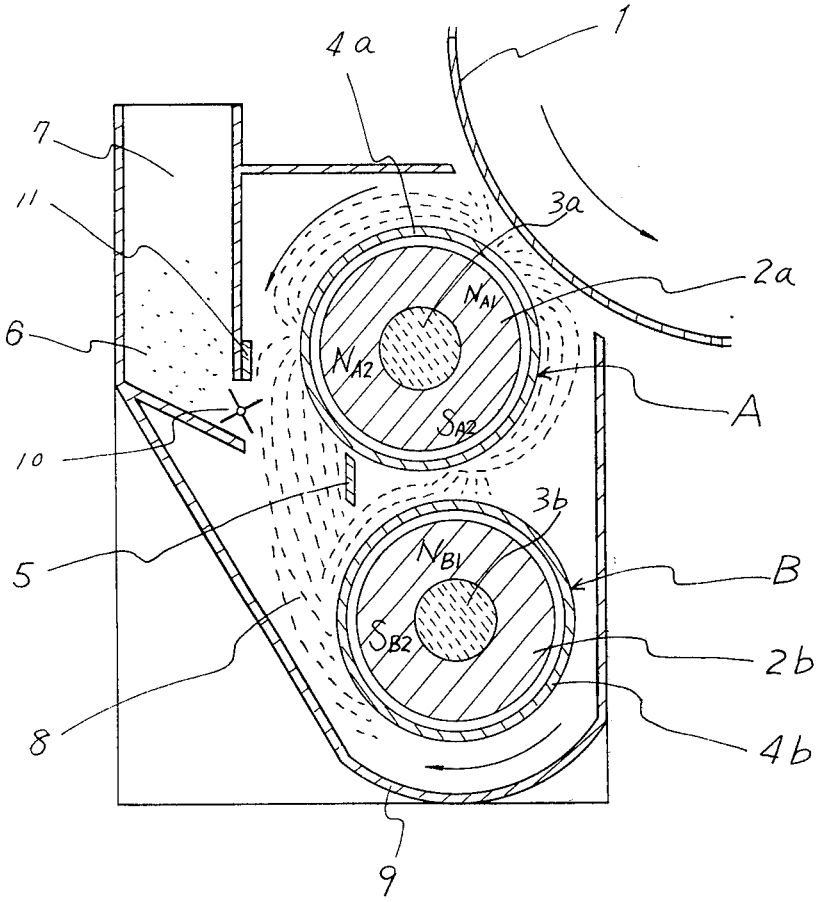

The present invention will now be described with respect to the embodiments as shown in the accompanying drawings in which:

FIG. 1 is a schematic sectional illustration of one embodiment of the developing device according to the present invention and FIG. 2 is similar illustration of another embodiment of the present invention.

Referring now to FIG. 1 which shows in section a developing device for electrophotography of the present invention, a rotary drum 1, only a part of which is shown for simplicity of illustration, has a surface made of selenium or zinc oxide thereon which bears an electrostatic latent image formed in the preceding stage and is adapted to rotate in the direction indicated by an arrow. Alternatively, arrangement may be made such that a sheet bearing an electrostatic latent image formed in the preceding stage is put on the surface of the rotary drum and carried therewith. A pair of magnet rolls A and B are juxtaposed near the rotary drum 1. The magnet roll A comprises a cylindrical magnet body 2*a* including four magnetic poles $S_{A1}$, $S_{A2}$, $N_{A1}$ and $N_{A2}$ spaced along its outer portion and a tube 4*a* located outside of the magnet body 2*a* rotatably with respect thereto. The magnet body 2*a* is made of, for instance, magnetic oxide suitable for magnet material and fixedly supported by a shaft 3*a* in a conventional manner. The four magnetic poles are arranged asymmetrically and the magnetic pole $N_{A1}$ is located adjacent the surface of the rotary drum 1. The cylindrical tube 4*a* is made of non-magnetic metal such as aluminum, stainless steel and brass and is rotated counterclockwise as indicated by an arrow by a conventional driving means such as an electric motor.

The magnet roll B is similar in construction to the magnet roll A and comprises a cylindrical magnet body 2*b* including four magnetic poles $S_{B1}$, $S_{B2}$, $N_{B1}$ and $N_{B2}$ and a rotatable tube 4*b* made of non-magnetic material. However, the tube 4*b* is rotated clockwise as indicated by an arrow in the drawing in synchronism with the rotatable tube 4*a*. The magnet body 2*b* is also fixedly supported by a shaft 3*b*. The magnet rolls A and B are shown in the drawing as having the same diameter, however, there is no problem with the magnet rolls A and B of different diameter, provided that peripheral speed of these two rolls is substantially the same.

A developer separation plate 5 is provided adjacent the surface of the rotatable tube 4*a* below it for facilitating separation of the surplus developer from the surface of the tube 4*a*. A supply of toner 6 is stored in a chamber 7 and is supplied to the stock of the developer 8 stored in the lower part of a developing housing 9, with the aid of a pawl wheel or a screw 10. The magnet rolls A and B may be incorporated in the housing 9 and, in this case, the magnet roll B is so arranged that the rotatable tube 4*b* thereof rotates while in contact with the developer 8.

The developing device with the arrangement above described will operate in the following manner.

In operation, the developer 8 of the developing housing 9 is magnetically attracted onto the surface of the rotatable tube 4*b* by the magnetic poles $N_{B2}$, $S_{B2}$ and $N_{B1}$ positioned on the magnet body 2*b* and is carried by the tube 4*b* as it rotates clockwise. The developer 8, when reached the magnetic pole $N_{B1}$, is transferred from the rotating tube 4*b* onto the surface of the rotating tube 4*a* by the attractive force of the magnetic pole $S_{A2}$ on the magnet body 2*a* which is located adjacent the magnet pole $N_{B1}$. As there is magnet repulsive field between the magnetic pole $S_{A2}$ on the magnet body 2*a* and the magnetic pole $S_{B1}$ which is located adjacent the surface of the rotary drum 1, due to the same polarity, any part of the developer 8 thus transferred onto the surface of the rotating tube 4*a* is not directed or returned to the surface of the rotating tube 4*b*, but magnetically strongly attracted to the rotating tube 4*b*. Thus no developer bears on the surface of the rotating tube 4*b* of the developer supply magnet roll B. The developer 8 carried by the rotating tube 4*a* to the magnetic pole $N_{A1}$ is formed into a magnetic brush at the place on the surface of the rotating tube 4*a* where the developing magnetic pole $N_{A1}$ of high intensity (for instance, approximately 500 to 1300 Gauss) is located. The magnetic brush rubs the surface of the rotating drum 1 bearing the electrostatic latent image thereon so that some of the toner of the developer 8 is electrostatically transferred onto the surface so as to change the image into a visible image. It occurs frequently that some of the carrier of the developer 8 adheres to the latent image on the drum surface. But the carrier is magnetically attracted by the magnetic pole $S_{B1}$ located on the magnetic body 2*b* of the developer supply magnet roll B as the drum rotates in the direction indicated by an arrow (cleaning function by the magnetic pole $S_{B1}$), and the carrier is returned to the developing housing 9 as the rotatable tube 4*b* rotates. For this reason, the carrier needs not be supplied all the time. The surplus of the developer 8 is carried with the rotating tube 4*a* with the aid of the magnetic pole $S_{A1}$ on the magnet body 2*a* towards the magnetic pole $N_{A2}$. The developer 8, after passing over the magnetic pole $N_{A2}$, is separated from the surface of the rotating tube 4*a* by the developer separation plate 5. This separation of the developer 8 is facilitated by the magnetic attractive force established between the magnetic pole $N_{A2}$ and the magnetic pole $S_{B2}$. The magnetic repulsion established between the magnetic pole $N_{A2}$ on the magnet body 2*a* and the magnetic pole $N_{B1}$ on the magnet body 2*b* is also effective for such separation of the developer. The developer thus separated from the surface of the tube 4*a* falls down by gravity into the developer housing 9. Some of the developer 8 are forced to collide against the pawl wheel 9 under the influence of the magnetic line of force produced by the magnetic pole $N_{A2}$ so that the fresh toner on the pawl wheel 9 is continuously supplied into the developing housing 9. A piece of a plate 11 made of ferromagnetic material such as iron may be arranged above the pawl wheel 10 on the outside wall of the chamber 7 to direct the developer 8 towards the pawl wheel 9. It is known in the art that the length of the magnetic brush by the magnetic pole $N_{A1}$ and the amount of the developer to be carried with the rotating tube have a great influence on the quality of the developed image and it is important to finely adjust them in the developing device. For this purpose, it is possible according to the present invention to adjust the magnet bodies 2*a* and 2*b* angularly so as to vary relation of magnetic interference produced between the magnetic poles on the two magnet bodies 2*a* and 2*b*.

In the embodiment as described above and as shown in FIG. 1, the magnetic poles of particular polarities are located on the particular places of the rotating tubes. However, it is to be understood that the polarities of such magnetic poles are not limitative, but may be reversed or suitably selected. It is also possible to suitably determine the rotational speed of the rotatable tubes depending upon diameter thereof.

FIG. 2 shows another embodiment of the invention which differs from the first embodiment of FIG. 1 only in the point that only the developing magnet roll A is located near the rotary drum 1 and each of the magnet rolls A and B has different number of magnetic poles thereon. It is seen, therefore, that the cleaning function by the magnet roll B is not achieved in this embodiment.

As seen from the foregoing description, the developing device according to the invention has a number of advantages which conventional developing devices are not enjoying. Some of the advantages are as follows:

1. Continuous supply of toner is attainable.
2. Perfect separation of the developer from the rotary tube is realized.
3. Cleaning of the carrier adhered to the drum surface is realized.
4. Toner and carrier are fully mixed on the rotary tube with the aid of their magnetic effect.
5. Design of the developing device is of compact type.
6. A constant amount of the developer is assured.

The developing device enables reproduction of good quality having no unevenness of transfer even when an image is transferred onto an ordinary paper.

What we claim is:

1. A developing device for use in electrophotography wherein a toner is applied to an electrostatical latent image supported on the surface of a member to make the image visible, comprising a rotatable member bearing an electrostatic latent image thereon; a first magnetic roll disposed adjacent to the member which comprises a rotational tube of non-magnetic material and a cylindrical fixed magnet body located in the tube and having more than two magnetic poles spaced from each other wherein one of the poles is located adjacent the surface of said member, said pole serving as a developing pole; a second magnet roll disposed adjacent to the member and adjacent to the first magnet roll, and a developer storing chamber, said second magnet roll comprising a rotational tube of non-magnetic material and a cylindrical fixed magnet body located in the tube and having more than two magnetic poles longitudinally arranged thereon wherein one of the poles is located adjacent to the surface of said member, another of said poles is located adjacent to the first magnet roll and another of said poles being immersed in said developer storing chamber; the tubes of the first and second magnet rolls being rotated such that the surfaces of said tubes move in the same direction with respect to each other at the point at which said tubes are adjacent to each other, the surface of said member being translated in the same direction as the tube of said second magnet roll at the location where the tube of the second magnet roll and the surface of said member are adjacent to each other, the developer being carried from the developer storing chamber to the portion of the first magnet roll opposite said member, the carrier particles adhered on the member being removed from said surface by the magnetic pole of the second magnet roll adjacent the surface of said member.

2. The developing device set forth in claim 1 wherein the first magnet roll further comprises a magnetic pole located opposite the second magnet roll and having a magnetic polarity opposing the polarity of the magnetic pole of the second magnet roll at said opposed location.

3. The developing device set forth in claim 2 wherein the magnetic pole located opposite the second magnet roll has a different polarity than the developing pole and wherein the magnetic coupling between them is greater than that between the opposing poles of said first and second magnet rolls.

4. The developing device set forth in claim 1 wherein the magnetic pole of the second magnet roll located adjacent the surface of the member has a different polarity from said developing pole.

5. A developing device as set forth in claim 1 characterized in that said one magnet roll has a third magnetic pole arranged oppositely to the outlet of said developer storing chamber and said other magnet roll has a third magnetic pole of opposite polarity to said third magnetic pole arranged substantially diametrically oppositely to said first magnetic pole and magnetic coupling between said two third magnetic poles is made rather great so as to separate the developer from said one magnet roll and to facilitate supply of the toner into the housing from said developer storing chamber.

6. A developing device as set forth in claim 5 characterized in that an additional magnet is arranged adjacent the outlet of said developer storing chamber for promotion of spring out of the toner.

7. A developing device as set forth in claim 1 characterized in that said magnet bodies of said one and the other magnet rolls can be angularly adjusted to control the relative positions of said magnetic poles of said magnet rolls with respect to each other as well as to said path for said image.

* * * * *

UNITED STATES PATENT OFFICE

CERTIFICATE OF CORRECTION

PATENT NO. : 4,008,686

DATED : February 22, 1977

INVENTOR(S) : Hiroshi Katakura and Keitaro Yamashita

It is certified that error appears in the above-identified patent and that said Letters Patent are hereby corrected as shown below:

On the title page, correct the listing of the Assignee to read:

--Assignee: Konishiroku Photo Industry Co., Ltd. and Hitachi Metals, Ltd.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*